United States Patent [19]

Beall et al.

[11] Patent Number: 4,824,121

[45] Date of Patent: Apr. 25, 1989

[54] DART GAME WITH PROGRAMMABLE DISPLAYS

[75] Inventors: Paul F. Beall; Eugene G. Harlan, both of Rockford, Ill.

[73] Assignee: Arachnid, Inc., Rockford, Ill.

[21] Appl. No.: 114,194

[22] Filed: Oct. 28, 1987

Related U.S. Application Data

[63] Continuation-in-part of Ser. No. 88,723, Aug. 24, 1987, Pat. No. 4,793,618, which is a continuation-in-part of Ser. No. 926,916, Nov. 3, 1986, abandoned.

[51] Int. Cl.[4] ..... F41J 3/00; F41J 3/02

[52] U.S. Cl. ..... 273/376; 273/DIG. 28; 273/1 ES

[58] Field of Search ..... 273/1 ES, 374–376, 273/DIG. 28

[56] References Cited

U.S. PATENT DOCUMENTS 4,516,781 5/1985 DeVale et al. ..... 273/376

*Primary Examiner*—Maryann Lastova

*Attorney, Agent, or Firm*—Leydig, Voit & Mayer

[57] ABSTRACT

In an electronic dartboard game having a visual display for providing players with game scores and the like, an apparatus for providing a customized image on the visual display when the electronic dartboard game is not in use is provided having, a processor operable in first or second modes. The first mode is responsive to game conditions for providing scoring information and the like to the visual display. The second mode is responsive to a manual input device for providing a customized image on the visual display. Additionally, there is provided an apparatus for transferring the processor from the first mode to the second and returning the processor to the first mode after the customized image has been entered.

10 Claims, 6 Drawing Sheets

45
DIAGN
46
ROM AND RAM CHECKSUM TEST
47
CHECKSUM TESTS O.K.?
NO
48
DISPLAY 'RAM BAD'
YES
53
DO LAMP TEST
54
DO SOUND TEST
55
TEST DISPLAYS
69
DISPLAY PROMPTING MESSAGE
'SELECT' PRESSED ?
YES
55a
NO
56
DISPLAY POPULARITY REGISTERS AND COIN COUNTER
YES
'ENTER' PRESSED ?
55b
NO
57
'TEST' PRESSED ? OR COIN IN
YES
58
SETUP
(FIG. 6)
NO
A
(FIG. 5b)
READ TARGET
59
60
DISPLAY VALUE IN TEMPORARY SCORE BOX

DART GAME WITH PROGRAMMABLE DISPLAYS

CROSS-REFERENCED TO RELATED APPLICATIONS

This application is a continuation-in-part of U.S. application Ser. No. 088.723, filed on Aug. 24, 1987, now U.S. Pat. No. 4,793,618, which is in turn a continuation-in-part of U.S. application Ser. No. 926,916, filed on Nov. 3, 1986, now abandoned.

TECHNICAL FIELD

The invention relates generally to electronic games, and more particularly to computerized target games which automatically register and display the score attained by players. In its principal aspect, the invention is directed to providing a programmable display that may be manipulated without the need for a conventional keyboard.

BACKGROUND OF THE INVENTION

Computerized target games are well known as exemplified by U.S. Pat. Nos. 4,057,251 to Jones et al., 4,561,660 to Zammuto and 4,586,716 to Brejcha et al. Many of these games employ video displays. As in many other types of electronic games, it is known in target games to provide a visual display which is intended to attract players. Such a display is generated when the game is not in use and the electronics operate in an "ATTRACT" mode. Often the game may be in the "ATTRACT" mode for a substantial time. Instead of displaying the "ATTRACT" image, owners or lessees may desire to utilize the display in a manner they consider more advantageous to their business. These "ATTRACT" mode displays are typically pre-programmed, however, and cannot be accessed by the owner or lessee of the game in order to customize the display for any particular purpose. This inflexibility of the display for the electronic target game prevents the owner/lessee from realizing the full capabilities of the video screens used in connection with the target games.

SUMMARY OF THE INVENTION

It is the primary object of the present invention to provide an alternative to the "ATTRACT" configuration for the video display of an electronic game that may be programmed by the owner/lessee without the need for a conventional keyboard. In this connection, it is a related object of the invention to provide an apparatus and method for allowing a owner/lessee of an electronic game utilizing a video display to program any desired message for display as an alternative to the preprogrammed "ATTRACT" display.

It is another object of the invention to provide an apparatus and method that allows for the free modification of the display generated by an electronic game when it is not in a playing mode.

It is a more detailed object of the invention to provide an apparatus and method responsive to the target of an electronic game for assembling an image for the video display of the game. Preferably, the target is in a conventional dartboard configuration and comprises a plurality of movable segments. By entering the electronics into a display modification mode, the segments are associated with symbols held in memory. By activating a segment of the dartboard, a particular symbol in memory is designated and displayed by the video display. Several of the segments of the dartboard are designated for the purpose of controlling the location of symbols on the screen. By responding to the activation of segments on the dartboard in the foregoing manner, the dartboard effectively becomes a keyboard for the entering of customized designs that may be displayed when the game is not operating.

Other objects and advantages of the invention will become apparent from the following detailed description and the accompanying drawings.

While the invention will be described in connection with a certain preferred embodiment, it will be understood that it is not intended to limit the invention to the illustrated embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
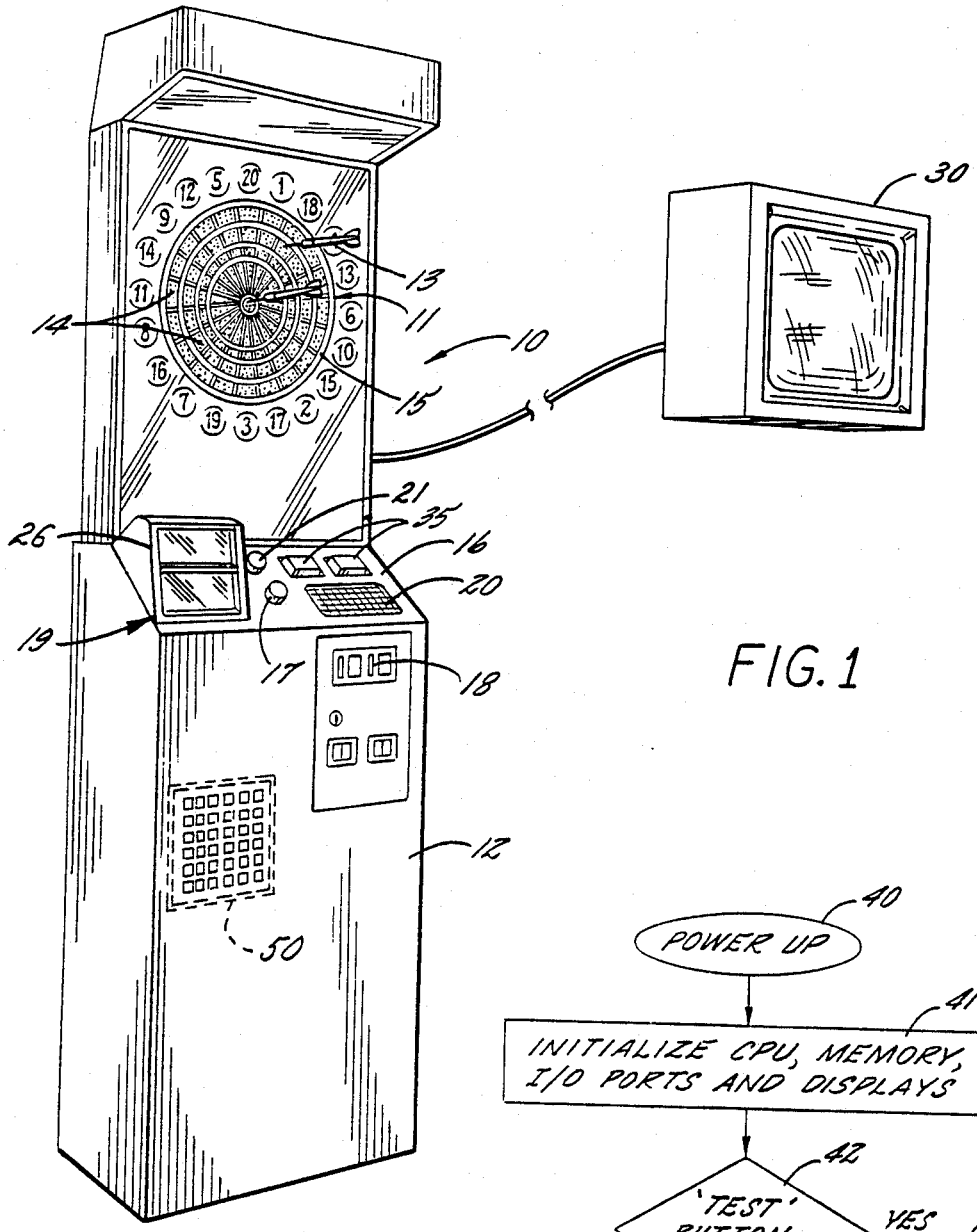
FIG. 1 is a perspective view of an exemplary electronic dart game which may incorporate the present invention.

Turning to the drawings and referring first to FIG. 1, an exemplary electronic dartboard incorporating the invention comprises a target head 11 mounted in an upright cabinet 12 for serving as a target for darts 13 which are adapted to be thrown at the target. The particular detailed construction of the target head 11 and the cooperating darts 13 is disclosed in the aforementioned U.S. Pat. Nos. 4,057,251 to Jones et al., 4,561,660 to Zammuto and 4,586,716 to Brejcha et al., and these patents are hereby incorporated by reference. As explained more fully in the Jones et al., Zammuto and Brejcha patents, the dartboard 11 is divided into a plurality of separate target sections 14 denoting different target areas. Each target section 14 contains a large number of closely spaced holes for securing a tip of a dart in the section in response to an impact of the dart caused by throwing the dart toward the target head.

In order to provide for automatic scoring of a dart game, each of the target sections 14 has a switch device (not shown in FIG. 1) located behind the section such that the impact force of a thrown dart hitting a target section displaces the section so as to momentarily close the switch device, thereby signalling to the internal electronics of the electronic dartboard that a particular target section has been hit. Each target section is resiliently biased outwardly so that after the impact of a dart, the section returns to its normal position which forms a flush surface with the other target sections. Preferably, the switches associated with the target sections are kept in their normal positions by the outward biasing of the target sections, using a resilient biasing material such as a solid rubber sheet. For the switches, a switch matrix of imprinted mylar sheets is preferably used, providing switching of the desired duration and continuity during the momentum transfer from a dart to a target section.

On the control panel 16 of the dart game are several push button switches 17, 21 for selecting between different dart games and various game options such as the number of players. For example, button 17 is a "select" button that allows the players to choose among a plurality of possible game formats. An example of a particular game is that of cricket as discussed more fully in the parent of this application. Other buttons may also be provided. For example, a "next player" button may be provided to signal, when necessary, that a particular player's turn is over. Such a button may be necessary in the event that a player throws a dart and completely misses the target head 11. For such situations, the internal electronics of the game is unable to detect that the player's turn is complete unless a "next player" button is provided.

Video display screens 19 and 26 are located along side the control panel 16 for displaying various information about the operation and conditions of the game. As an optional feature, a remote video display 30 may also be provided for displaying the same information as appears on video display screens 19 and 26.

In the initial stage of a game, the displays 19 and 26 respond to the number of coins received through the coin slots 18 and provide an indication of the number of players in the game. In response to activation of the game by detection of the coins, the video displays 19 and 26 guide a player through the selection of a particular game format, using the "select" button 17 to choose the desired format. A series of audible tones are generated by a speaker 20 to guide a player through the selection process. For example, a bell tone may be used to assist the player by acknowledging that a choice has been registered or a buzzard sound may inform the player that an attempted entry is invalid.

At the heart of the operation of the dart game is a microprocessor-based electronics system that responds to the target head 11 of the dartboard and the input push buttons 17 and 21 on the cabinet 12. In a conventional manner, a microprocessor 22 shown in FIG. 2 communicates with the switch matrix 25 of the target head 11 and the push buttons 17 of the control panel 16 via a bus line 31. Also in a conventional manner, the microprocessor 22 accesses various memories via a bus line 32. Specifically, a random access memory (RAM) 28 provides the microprocessor with a working area to calculate and store temporary values. A erasable programmable read-only memory (EPROM) 27 stores the instructions necessary to execute a game. As discussed more fully hereinafter, a symbol memory 33 and screen map memory 37 are also provided.

The RAM 28 is supplied with an internal battery backup (not shown), and a small portion of the memory may be used by the microprocessor 22 to store such information as high scores, game popularity data or similar values which are desired to be retained when the power is off. Included with the instructions in the EPROM 27 for executing proper operation of the games are instructions for initialization, game and player selection processes, and all the instructions necessary to play each of the available game formats.

Preferably, the EPROM 27 is contained within a single unit such as a cartridge which may easily be removed and interchanged, thus allowing a different set of instructions to be used for operation. This feature provides a convenient means for changing the rules of particular games, perhaps for a certain geographical region where such rules are more common or preferred. Whenever such a change is made, all the other components and connections remain the same except for the EPROM 27 and a listing on the control panel 16 of the available games. This feature also allows games to be changed periodically to produce variety and may also be used to keep more popular games or rules available.

Synchonization or the various operations of the dartboard electronics is done via the reset and interrupt time circuitry 29 which alerts the electronics to interrupt and reset conditions, such as may occur when coins are dropped into the coin slots 18 or certain signals from the control panel 16 are received. As for specific signals to and from the control panel 16, signals from the push button inputs 17 are linked to the microprocessor via the control panel input/output circuitry 26. This control panel input/output circuitry 26 also drives the indicator lamps 35 on the control panel 16. The microprocessor 22 sends appropriate signals to the sound circuitry 23 for driving the speaker 20 and generating a variety of different sound effects. The microprocessor 22 also sends appropriate signals to the video generator with video RAM 24 to drive the video displays 19 and 26 according to different events and conditions of a game. For driving an optional Liquid Crystal Display 38, the LCD driving circuit 44 is provided.

In response to the impact of darts on the dartboard, signals from the target head 11 and switch matrix 25 are generated and delivered to a target head interface circuitry 36 for conversion to a form which may readily be read and recognized by a target head input/output circuitry 34. At appropriate times during a game, the throw and remove darts indicator lamps 39 (not shown in FIG. 1) are driven by the target head input/output circuitry 34 in response to control signals from the microprocessor 22.

Figure 3:
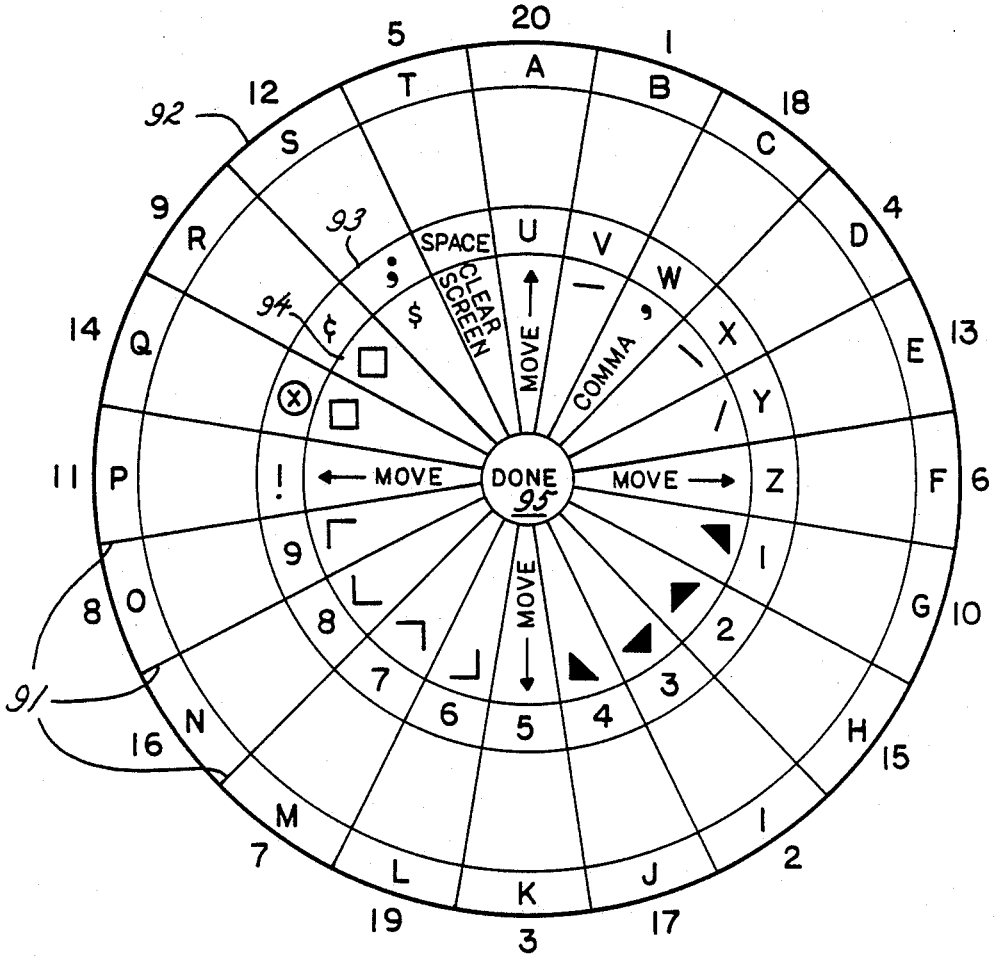
FIG. 3 is a chart illustrating a schematic representation of the segments comprising the dartboard of the electronic dart game in FIG. 1, including designations for each segment used in accordance with the invention to provide a programmable display.

In accordance with one important aspect of the invention, the microprocessor 22 is operable in alternative modes, wherein a first mode executes game instructions in response to activation of switches in the switch matrix 25 and a second mode generates a customized image on the video displays for display when the dartboard is not being played. A owner/lessee of an electronic dartboard may generate a customized "ATTRACT" display by first transforming the microprocessor 22 from its normal first mode of operation to the second mode and thereafter manually pressing either predetermined target segments or keys on a separate keyboard in order to generate symbols on the video displays 19 and 26 and control their locations. In the preferred embodiment, the target segments are associated with symbols used to construct a customized display. The symbols need not appear on the segments themselves; instead, a chart such as shown in FIG. 3 may be used as a map for determining which segment corresponds to a desired symbol, thereby effectively making the plurality of target segments function as a keyboard. In the alternative embodiment, a separate keyboard 50 illustrated in phantom lines in FIG. 1 provides the means for imputing the symbols.

The symbols available for the customized display are held in the symbol memory 33. Preferably each symbol is coded to fit within an 8×8 pixel pattern on the video display. When in its second mode, the microprocessor 22 responds to selection of a particular target segment by generating a memory address for the associated symbol. The symbol is delivered to the video generator with video RAM 24 for display on the video displays 19 and 26.

In keeping with the invention, several of the target segments are reserved to operate in the second mode as control keys for moving symbols to desired locations on the video screen or clearing the display. In order to prompt the programmer, a cursor is generated on the video display. The cursor movement is limited to the pixel area intended for the customized display. For example, the screen area available for the d is preferably limited to a matrix of 16×32 symbols. One target segment is reserved for erasing the screen and another, preferably the bull's-eye, is reserved for exiting from the second mode and returning to the first mode.

In the specific illustrated embodiment, the conventional configuration of a target head for a dart game (e.g., concentric rings intersected by radial lines) is reproduced as a chart wherein symbols or legends are printed within the boundary of the sections. Associated with a first group of sections defined by the radial lines 91 and the first and second rings 92 and 93 (i.e., the "Doubles" segments) are the first 20 letters of the alphabet A through T. A second group of segments defined by the radial lines 91 and the second and third rings 93 and 94 (i.e., the "Triples" segments) is associated with the remaining letters of the alphabet N through Z, numbers 1–9 and miscellaneous characters such as an exclamation point (!) and a semi-colon (;). One of the segments in this second group is reserved for providing a space between adjacent characters. Formed by the radial lines 91 between the third ring 94 and a bull's-eye 95 is a third group of segments (i.e., the "Single" segments) that include additional miscellaneous symbols such as a comma (,) and a dollar sign ($).

This third group also contains the segments that provide control functions. For example, four of the segments are provided for moving a display cursor up and down and from side to side. As illustrated, each of the control segments for the cursor is preferably oriented in the direction that it moves the cursor. Therefore, each cursor control segment is positioned approximately at right angles to two of the other cursor control segments and diametrically opposite the third. In order to provide for easy erasure of the screens of the displays 19 and 26, one of the segments in the third group clears all previously programmed symbols from the display.

The bull's-eye 95 provides the programmer with an exit from the second mode. In this connection, when the screen has been constructed as desired, the bull's-eye is pressed and the microprocessor 22 returns to the first mode where further manipulation of the segments will not effect the constructed image.

Figure 2:
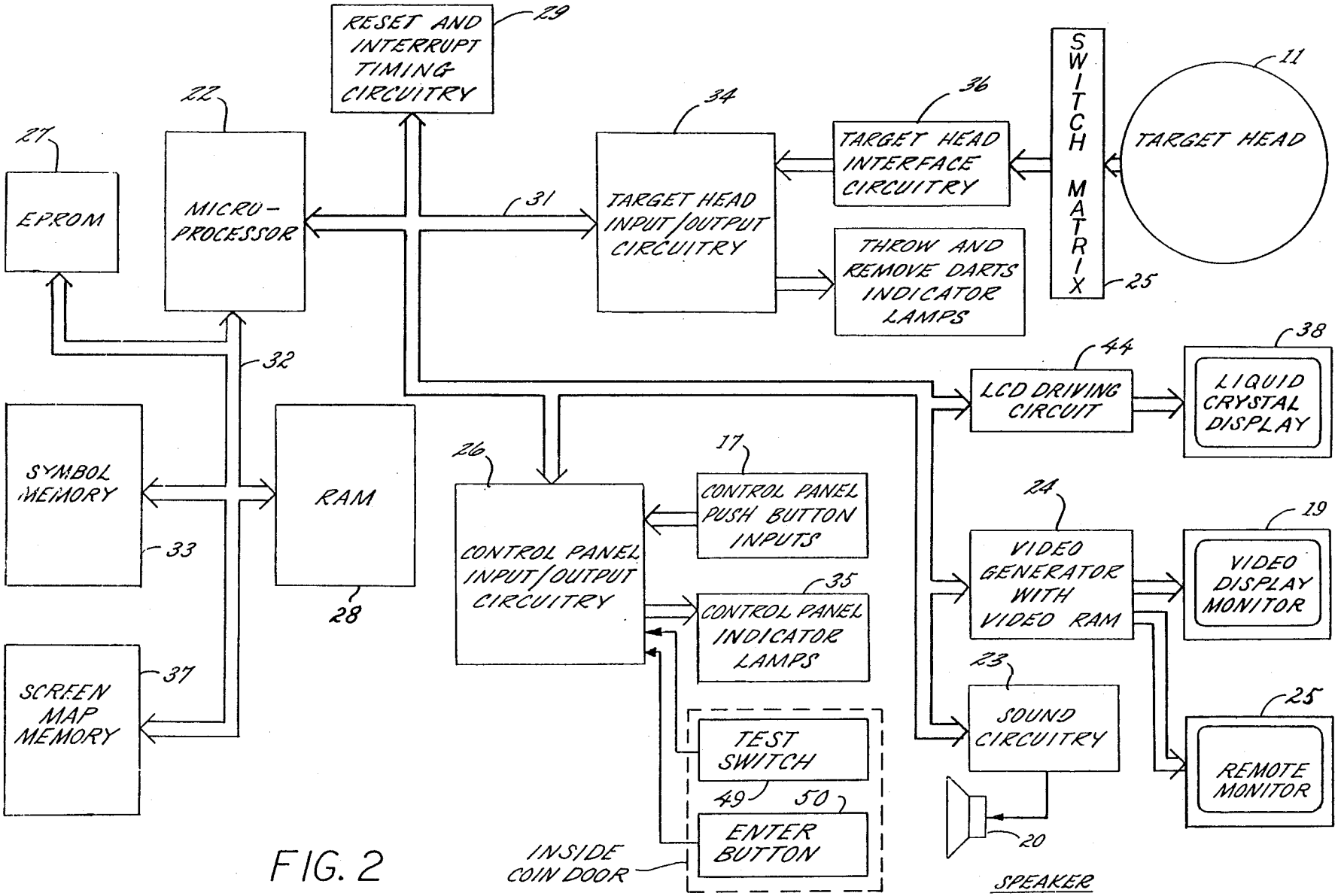
FIG. 2 is a schematic block diagram of the microprocessor-based electronics incorporated in the electronic dart game of FIG. 1, including the electronics responsive to the dartboard for programming the video display in accordance with the invention.

In order to retain the image constructed during operation of the microprocessor 22 in the second mode, the screen map memory 37 in FIG. 2 maintains the image after it has been removed from the video generator with video RAM 24. Preferably, the symbols generated by the activation of a switch in the switch matrix while the microprocessor 22 is in its second mode are stored in both the video generator with video RAM 24 and the screen map memory 37. The screen map memory is organized to correspond to the maximum 16×32 symbol size of the customized display. It will be appreciated by those skilled in the art that such a construction best matches the information in the character memory to the format of the display screen of the video displays 19 and 26.

In keeping with the invention, at least one manually operable switch that is not accessible by the public transfers operation of the microprocessor-based electronics of FIG. 2 from its first mode to its second. In the preferred embodiment, a "Test" switch 49 (shown in FIG. 2) is located in the coin box area and behind the coin box door. Activation of the "Test" switch 49 institutes a DIAGNOSTICS routine (FIG. 5) that is executed by the electronics of FIG. 2. At the end of the DIAGNOSTICS routine, the user is prompted by the display (either on the LCD or on the video displays) of a message to "Press Enter For Text Input" or "Press Select For Report". By pressing the "Select" button 17 on the control panel 16, information regarding how many total games have been played and the like is displayed. By pressing an "Enter" button 50 located inside the coin box with the "Test" button 49, the microprocessor 22 enters its second mode and generates a cursor in the upper left-hand corner of the available field on the displays 19 and 26. An image can now be constructed by entering symbols at the locations designated by the position of the cursor.

Figure 4:
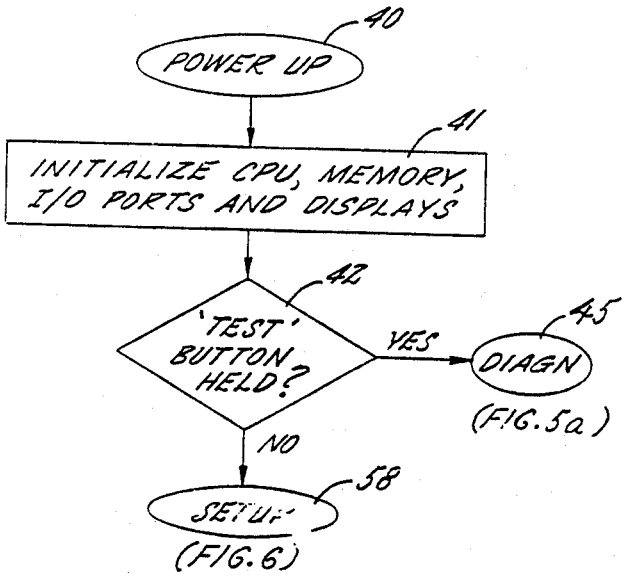
FIG. 4 is a flowchart of a POWER-UP routine executed by the electronics of FIG. 2 and instituted upon the application of power to the electronic dart game.

Turning now to FIG. 4, a flow diagram of the POWER-UP procedure of the invention executed by the electronics of FIG. 2 and instituted upon the application of power to the electronic dart game is shown. Upon POWER-UP (step 40), an initialization routine begins at step 41 which includes initializing various parts of the CPU such as the program counter, stack pointer and internal registers. The RAM memory is then initialized along with the various I/O ports and displays. Next, in step 42, if the TEST button 49 (located behind the coin slot door) is depressed, a DIAGNOSTIC routine will be run at step 45; otherwise game SETUP procedures will begin at step 58.

Figure 5A:
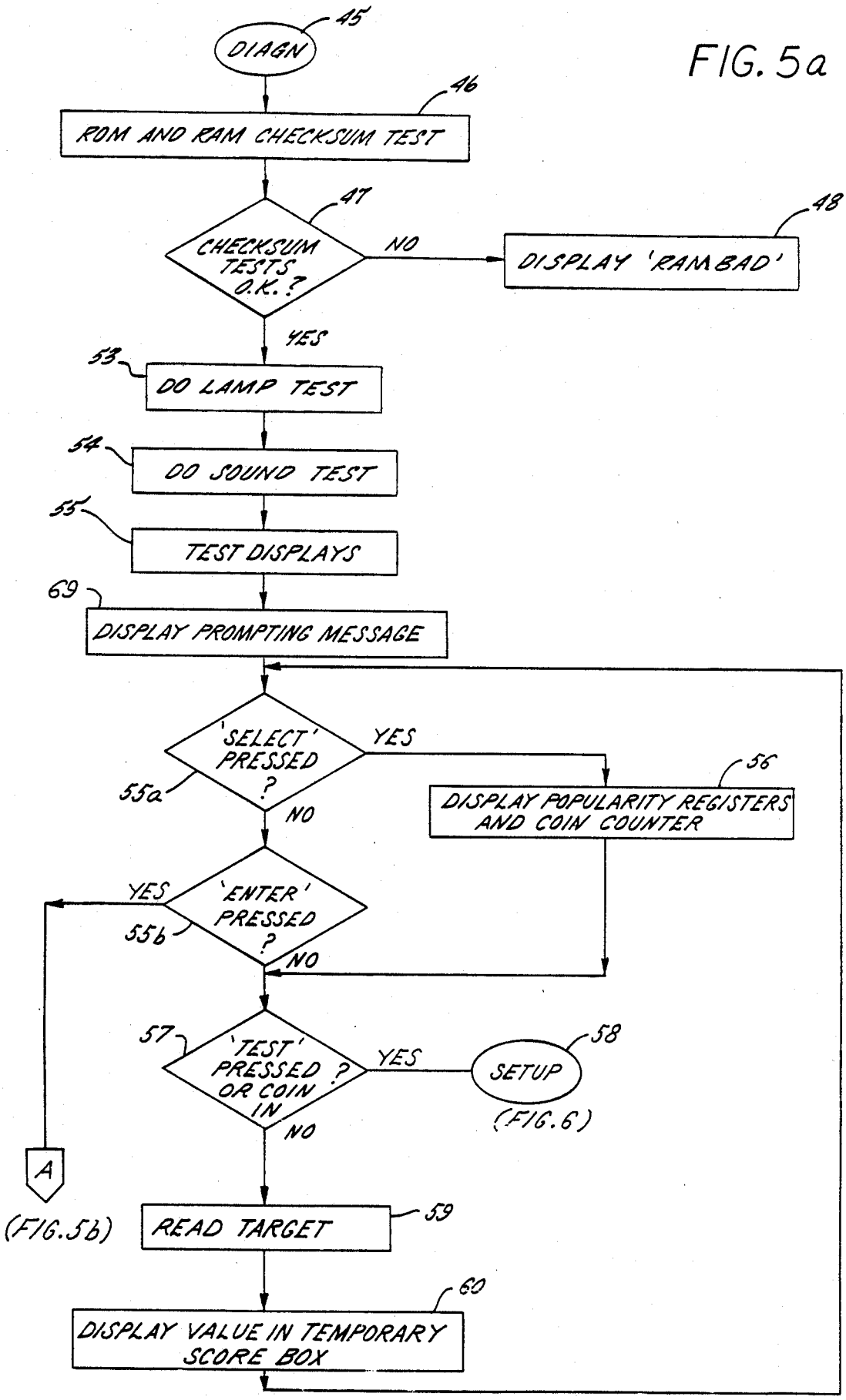
FIGS. 5*a* and 5*b* are a flowchart of a DIAGNOSTICS routine executed by the electronics of FIG. 2 and instituted in order to program the video display in accordance with the invention.
Figure 5B:
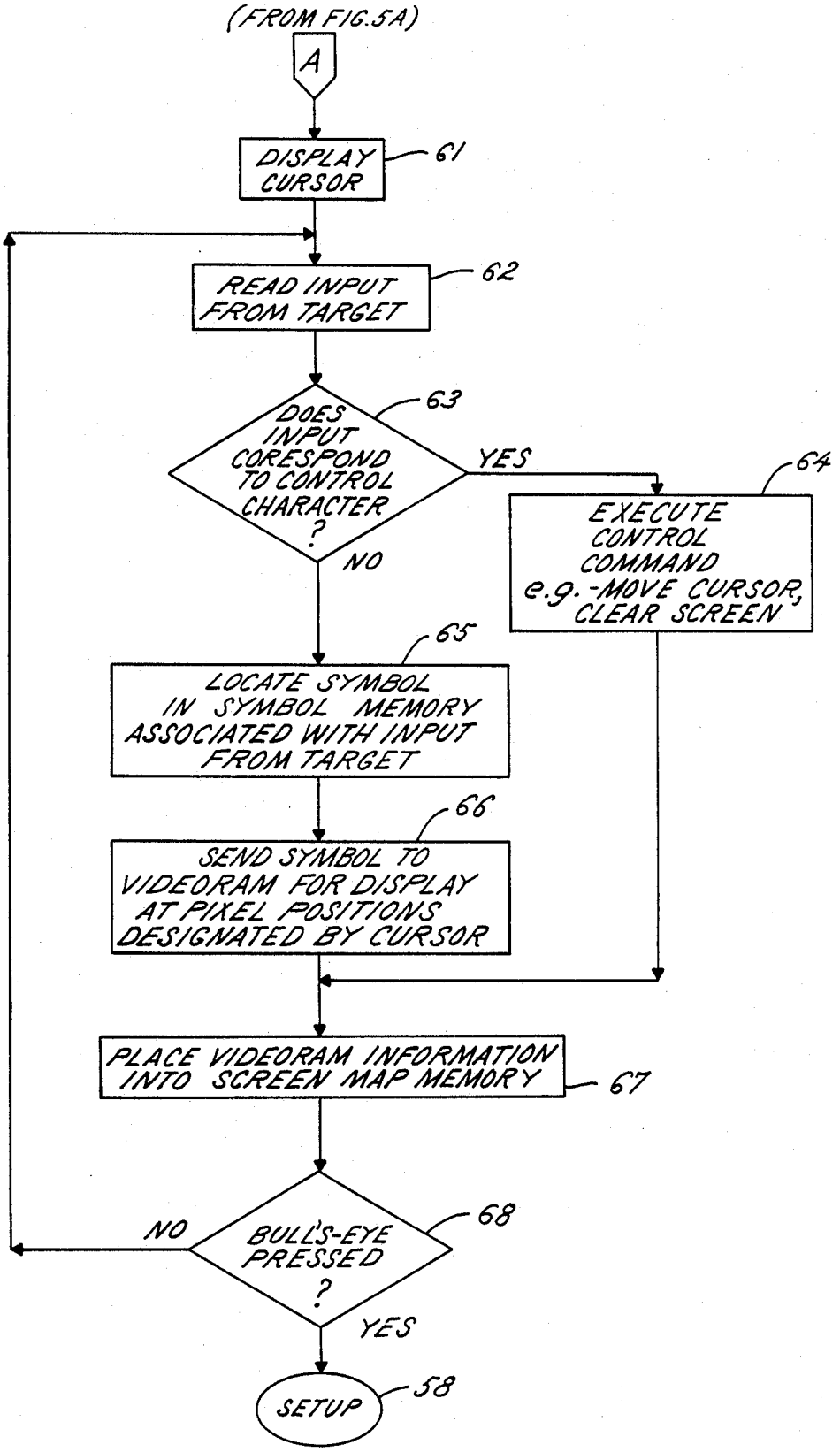

A flow diagram of the DIAGNOSTIC routine executed by the electronics of FIG. 2 and instituted in order to program the video display in accordance with the invention is given in FIGS. 5*a* and 5*b;* it initially tests and checks several elements of the invention to insure proper operation. The first step in the DIAGNOSTIC routine is the ROM and RAM checksum test in step 46. In step 47, if the results of the checksum tests show no indication of error, then execution continues to step 53; otherwise, a "RAM BAD" message is displayed in step 48. Upon completion of a good checksum test, the lamps on the game are tested individually in step 53, along with a test of the various sounds (step 54) and the displays (step 55). Next, in step 69, a prompting message is displayed. If the SELECT button 17 is pressed (step 55*a*), the game popularity registers and coin counter values are displayed as read from the RAM with internal battery backup. At this point in step 57, if the TEST button 49 has been pressed or a coin has been received then the SETUP procedure is initiated from step 58. Otherwise, further diagnostic testing is done consisting of the dart board switch matrix being read (step 59) and displayed (step 60). This additional diagnostic procedure then loops back to step 55*a* and repeats until the TEST button 49 has been pressed or a coin has been received which begins the SETUP procedure in step 58 or the ENTER button 50 has been pressed (step 55*b*) which will begin the second mode of operation to allow a customized "ATTRACT" screen to be entered as described above and in accordance with FIG. 5*b*.

Upon the depression of the ENTER button 50, the apparatus will enter its second mode of operation to allow the owner/lessee to enter a customized image on displays 19 and 26 through microprocessor 22 (FIG. 2) which causes a cursor to be displayed on displays 19 and 26 at step 61. At step 62, microprocessor 22 will read the input from the target head. In an alternate embodiment, a keyboard as described above may be provided for the input data. The microprocessor 22 will, at step 63, determine if the input corresponds to a control character such as a move cursor command, clear screen command, or the like, or a symbol. If a control character is entered, the microprocessor 22 will cause the control command to be executed (step 64). In the alternative, if the input signal is a symbol, the symbol associated with the input will be located from symbol memory 33 and sent to the video RAM 24 for display at the pixel position corresponding to the cursor (steps 65 and 66). Whether a symbol input or control character is input at step 63, the microprocessor 22 will place the video RAM 24 information into the screen map memory 37 at step 67. After placement of the video RAM 24 information into the screen map memory, step 68 tests for a finished or end condition. If the Bull's-eye 95 is pressed, indicating the operator is finished entering the customized screen, the SETUP procedure is initiated. If the Bull's-eye 95 is not pressed, the microprocessor 22 will loop back to step 62 and repeat the above steps until the Bull's-eye 95 is pressed.

Figure 6:
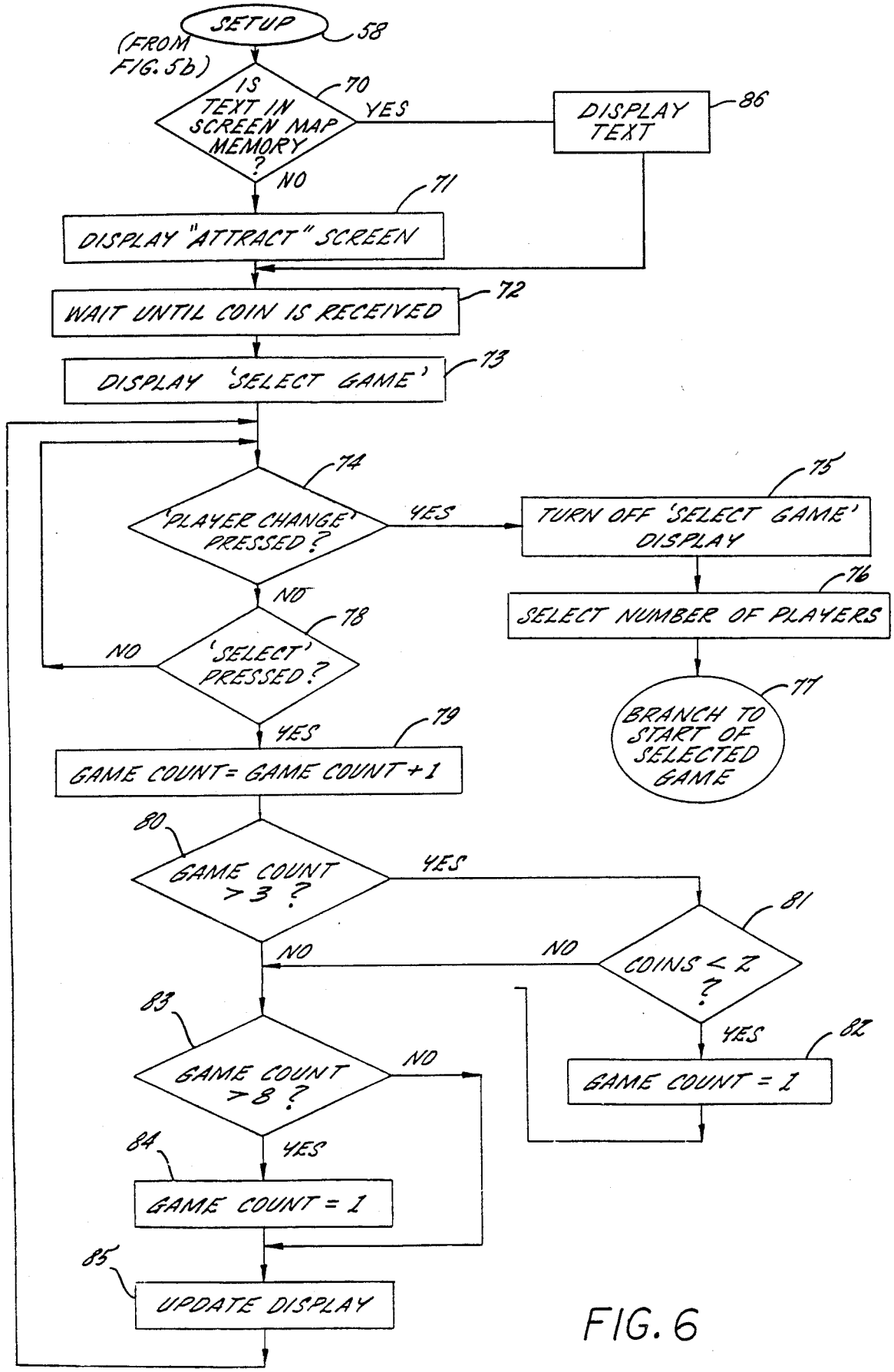
FIG. 6 is a flowchart for a SET-UP routine executed by the electronics of FIG. 2 upon exiting from the DIAGNOSTICS routine, where either the preprogrammed "ATTRACT" image or the user-programmed image of the invention is displayed until play is initiated.

The game SETUP procedure executed by the electronics of FIG. 2 upon exiting from the DIAGNOSTICS routine (FIGS. 5*a* and 5*b*), where either the preprogrammed "ATTRACT" image or the user-programmed image of the invention is displayed until play is initiated is shown in FIG. 6. The SETUP procedure also counts the money received, selects the particular game to be played and selects the number of players in the game. In the present embodiment of the invention there are eight different games and two cost categories—the one-coin games and the two-coin games. Games 1 through 3 are designated as one-coin games and games 4 through 8 are designated as two-coin games.

The SETUP procedure begins by determining whether any text is in the screen map memory 37 (step 70). If the owner/lessee image has been entered, the image will be displayed (step 86) or displays 19 and 26. If there has been no text entered by the owner/lessee, the default "ATTRACT" screen will be displayed (step 81). Until a coin is received by the game, the "ATTRACT" screen or the customized screen will be displayed on display screens 19 and 26 to draw attention and attract players to the game.

Upon receiving a coin in step 72, a SELECT GAME display is shown in step 73 to provide information and the ability for selecting a particular game of the many which are available. As is apparent from FIG. 2, information for display may be routed to the video display or the LCD display, or preferably both displays. During the game selection procedure, one of the games is designated as the 'current' game. This is done by distinguishing one game from the others by boxing the name, or using flashing or highlighting display attributes. The player has the option of selecting the 'current' game or changing the 'current' game to the next available game in the sequence. In step 74, if the PLAYER CHANGE button is pressed, the 'current' game is selected. The displays are then updated in step 75, the number of players for the game are determined from the number of coins received in step 76 and execution branches to the start of the selected game from step 77. If in step 78 the SELECT button 17 was pressed instead of the PLAYER CHANGE button then the game count is incremented as in step 79. Step 80 checks which cost category the 'current' game is in. If the game count is greater than 3, then it is a two-coin game and step 81 is done, otherwise it is a one-coin game and step 83 is done. In step 81, if the game has received less than two coins, then the game count is set back to 1 in step 82, so a two-coin game cannot be selected. In step 83 the game count is checked to see if it is greater than the maximum number of 8. If the game count is greater than 8 then it is set back to 1 in step 84, otherwise step 84 is bypassed. Next, in step 85, the displays are updated to reflect the new selection information, then the procedure loops back to step 74 for another selection iteration. This looping continues until a game selection is made in step 74, which in turn results in the start of the selected game in step 77.

From the foregoing, it can be seen that a owner/lessee of an electronic game which utilizes a video display may program any desired message for display as an alternative to the pre-programmed "ATTRACT" display.

We claim:

1. An electronic target game for automatically tallying and displaying the score of a game, wherein projectiles are thrown at a target board, said electronic target game comprising:

a display;

said target board comprising a plurality of moveable segments mounted to a switch martrix such that each segment is associated with at least one switch of said switch matrix such that movement of a segment activates at least one switch;

a processor means responsive to the activation of the switches of said switch matrix in both a first mode and a second mode; and a means for placing said processor means in either said first mode or said second mode;

said first mode responsive to activation of the switches of said switch matrix for providing game condition information to said display; and said second mode responsive to activation of the switches of said switch matrix for providing a customized image to said display when said electronic target game is not tallying and displaying said score of said game.

2. An electronic target game as set forth in claim 1 wherein said processor means includes a symbol memory that associates a first selected group of segments of said target board to symbols such that movement of a segment when said processor means is in said second mode causes an associated symbol to be displayed by said display.

3. An electronic target game as set forth in claim 2 wherein said processor means in said second mode includes means responsive to a second selected group of segments of said target board for controlling the placement of said symbols on said display.

4. An electronic target game as set forth in claim 1 wherein said display is a video display.

5. An electronic dartboard game for automatically tallying and displaying the score of a game wherein projectiles are thrown at a target head and for displaying a customized image comprising:

a visual display operable in a first or second mode;

input means for alternatively receiving scoring data or for entering customized image data, said display displaying said customized image when said electronic dartboard game is not tallying and displaying said score of said game;

a first means responsive to game conditions to store said game conditions for display on said visual display;

a second means responsive to said input means for programming a customized image for storing said customized image for display on said visual display;

means for switching said visual display between said first and second modes;

said first mode responsive to said first means for providing game condition information; and said second mode responsive to said second means for providing said customized image.

6. An apparatus as claimed in claim 5 wherein said target head has at least a first selected group of segments such that movement of a segment causes a symbol associated with said segment to be stored in said second means for display on said visual display when said visual display is in said second mode.

7. An apparatus as claimed in claim 6 wherein said target head has at least a second selected group of segments, said second group of segments operable to control the placement of symbols on said visual display when said visual display is in said second mode.

8. An apparatus as claimed in claim 5 wherein said visual display is a video display.

9. An apparatus as set forth in claim 5 wherein said input means includes (1) a keyboard for entering said customized image when said visual display is in said second mode and (2) said target head for receiving scoring data when said visual display is in said first mode.

10. An apparatus as set forth in claim 5 wherein said input means is said target head such that said target head alternatively receives scoring data when said display is in said first mode and enters customized image data when said display is in said second mode.

* * * * *